US008777762B2

(12) United States Patent
Morand et al.

(10) Patent No.: US 8,777,762 B2
(45) Date of Patent: Jul. 15, 2014

(54) MOBILE CABIN AND SUBSET FOR THE RECEPTION AND THE TRANSPORT OF AT LEAST ONE PASSENGER, AND RECREATIONAL FACILITY USING THE SAME

(75) Inventors: Yannick Morand, Grenoble (FR); Philippe Desflammes, Gruffy (FR); Jean-Francois Mugnier, Grand Junction, CO (US)

(73) Assignee: Sigma Composite, Veyrins Thuellin (FR)

( * ) Notice: Subject to any disclaimer, the term of this patent is extended or adjusted under 35 U.S.C. 154(b) by 137 days.

(21) Appl. No.: 13/550,206

(22) Filed: Jul. 16, 2012

(65) Prior Publication Data

US 2013/0023350 A1 Jan. 24, 2013

Related U.S. Application Data

(60) Provisional application No. 61/510,774, filed on Jul. 22, 2011.

(30) Foreign Application Priority Data

Jul. 22, 2011 (FR) ..... 11 02305

(51) Int. Cl.
*A63G 27/02* (2006.01)
*A63G 27/00* (2006.01)

(52) U.S. Cl.
USPC ..... 472/30; 472/44

(58) Field of Classification Search
CPC ..... A63G 21/00; A63G 21/20; A63G 21/08; A63G 27/00; A63G 7/00
USPC ..... 472/30–46, 59, 130; 104/53, 57, 63
See application file for complete search history.

(56) References Cited

U.S. PATENT DOCUMENTS

| | | | | |
|---|---|---|---|---|
| 1,557,942 | A | 10/1925 | Matthews | |
| 6,158,354 | A | 12/2000 | Eiraku | |
| 6,884,177 | B2 * | 4/2005 | Zambelli et al. | 472/47 |
| 6,994,629 | B2 * | 2/2006 | Bussink | 472/44 |
| 7,931,539 | B2 * | 4/2011 | Chen | 472/2 |
| 2010/0234119 | A1 | 9/2010 | Chen | |

FOREIGN PATENT DOCUMENTS

| | | | |
|---|---|---|---|
| AT | 392 598 | B | 4/1991 |
| CA | 2 646 613 | A1 | 6/2009 |
| EP | 2 075 043 | A1 | 7/2009 |
| WO | WO 2006/061648 | | 6/2006 |
| WO | WO 2007/044708 | A2 | 4/2007 |
| WO | WO 2007/139508 | A1 | 12/2007 |
| WO | WO 2008/041842 | A2 | 4/2008 |

* cited by examiner

*Primary Examiner* — Kien Nguyen
(74) *Attorney, Agent, or Firm* — Oliff PLC

(57) ABSTRACT

A motorized driving device drives the counterweight between balancing positions for balancing the cabin around a predetermined angular orientation of the cabin relative to the horizontal, by gravity of the whole formed by the cabin together with a possible load in this cabin.

9 Claims, 5 Drawing Sheets

MOBILE CABIN AND SUBSET FOR THE RECEPTION AND THE TRANSPORT OF AT LEAST ONE PASSENGER, AND RECREATIONAL FACILITY USING THE SAME

TECHNICAL FIELD OF THE INVENTION

The invention refers to the field of the transport of passengers in conveyed cabins and finds in particular application in recreational facilities such as those commonly referred to as Ferris wheel. More precisely, the invention relates to a mobile cabin for the reception and the transport of at least one passenger, of the type that is intended to be mounted on a mobile support so as to rotate about a substantially horizontal axis of rotation. In such a configuration, the cabin together with a possible load in this cabin form a whole with a center of gravity moving as said load moves.

The invention also relates to a mobile subset for the reception and the transport of at least one passenger, of the type including at least one cabin for the reception and the transport of at least one passenger and at least one mounting device for mounting this cabin on a mobile support so that it rotates about a substantially horizontal axis of rotation.

The invention also relates to a recreational facility, of the type including a succession of mobile subsets for the reception and the transport of passengers, at least one mobile support supporting at least one of the mobile subsets, a fixed supporting structure for supporting the mobile support, as well as a driving system for driving the mobile support relative to the fixed structure.

STATE OF THE ART

Recreational facilities of the type Ferris wheel, as well as others, use cabins driven along a way with a variable slope. These cabins can be suspended in such a way that they are suitably oriented by their own weight relative to the vertical, so that their respective floors are maintained horizontal.

Each cabin can also be mounted on a mobile support whose orientation follows the variations of slope of the path. A recreational facility having such an arrangement is described in European patent application EP-2 075 043. Any cabin of this recreational facility is supported by a carriage with which it is associated by means of a pair of vertical annular mounting bearings. Each cabin can thus turn round on itself so that, when the slope of its path varies, its orientation can be constantly adapted and maintained substantially constant relative to the horizontal.

Each cabin of the facility proposed in above-mentioned application EP-2 075 043 is equipped with a toothed crown wheel surrounding it coaxially with the two annular mounting bearings. A gear driven by an electric motor comprises a toothed wheel in mesh with the toothed crown wheel, so that it can make the cabin turn round on itself. This gear and an on-board electronic control are involved in the continuous adjustment of the angular orientation of the cabin relative to the horizontal. More precisely, the electronic control receives information about the clock position of the cabin along its circular path, in the case of a recreational facility of the type Ferris wheel. From this information, the electronic control controls the electric motor, after having determined the angular orientation that the cabin must have relative to its support in order that the floor of this cabin is horizontal.

The toothed crown wheel is a heavy and expensive part, which each cabin must nevertheless have. Moreover, a clutch is arranged so that the electric motor and the toothed wheel can be uncoupled at any time for reasons of safety. Like the toothed wheel, such a clutch is heavy and expensive.

SUMMARY OF THE INVENTION

It would be advantageous to propose an alternative to the solution in which a crown wheel surrounding the space for the reception of one or more passengers in a cabin of the above-mentioned type is used to continuously determine the angular orientation of this cabin relative to the horizontal.

According to the invention, a cabin of the above-mentioned type includes at least one counterweight movable between balancing positions away from a vertical plane containing the axis of rotation. A motorized driving device drives the counterweight between the balancing positions for balancing the cabin around a predetermined angular orientation of the cabin relative to the horizontal, by correcting the horizontal position of the center of gravity.

The cabin according to the invention can embody one or more other advantageous features, separately or in combination, in particular among those defined below.

Advantageously, the driving device includes at least one motor for displacing the counterweight between said balancing positions, at least one sensor for detecting the angular orientation of the cabin around its axis of rotation, relative to the horizontal, and a unit for checking this angular orientation, from a measure from the sensor, and controlling the motor in order to stabilize said angular orientation of the cabin around said predetermined angular orientation.

Advantageously, the counterweight is movable at least in a direction substantially orthogonal to said axis of rotation.

Advantageously, the mobile cabin comprises a floor, under which are located the counterweight and at least a part of the driving device for driving this counterweight.

Advantageously, the counterweight is arranged in a lower position than the axis of rotation of the cabin.

According to the invention, there is also provided a mobile reception and transport subset of the above-mentioned type. Its mobile cabin is such as previously defined.

The mobile subset according to the invention can embody one or more other advantageous features, separately or in combination, in particular among those defined below.

Advantageously, the mounting device is a device for mounting the cabin so that it can turn round on itself.

Advantageously, the mounting device is a device for suspending the cabin from the mobile support.

According to the invention, there is also provided a recreational facility of the above-mentioned type. At least some of the mobile subsets in the recreational facility are such as previously defined.

BRIEF DESCRIPTION OF THE DRAWINGS

Other possible advantages and features will more clearly arise from the following description of particular embodiments of the invention given as nonrestrictive examples and represented in the annexed drawings, among which.

DESCRIPTION OF PREFERENTIAL EMBODIMENTS OF THE INVENTION

Figure 1:
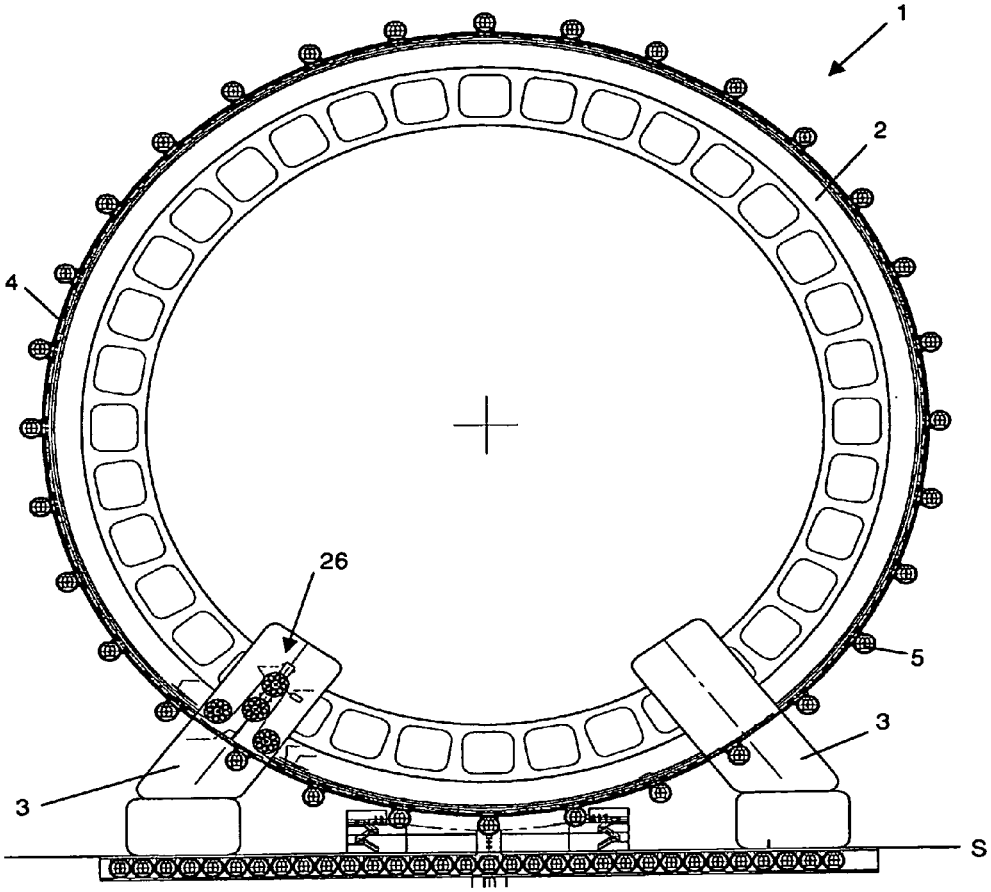
FIG. 1 is a side view of a recreational facility which implements the invention and which comprises a succession of mobile reception and transport cabins according to a first embodiment of the invention.

In FIG. 1, a recreational facility of the type vertical Ferris wheel is indicated by the reference 1. It includes a fixed central structure 2, which is supported by two legs 3 anchored in the ground S. In the illustrated example and in a nonrestrictive way, the fixed central structure 2 has the shape of a crown supporting a circular guiding path 4.

Figure 2:
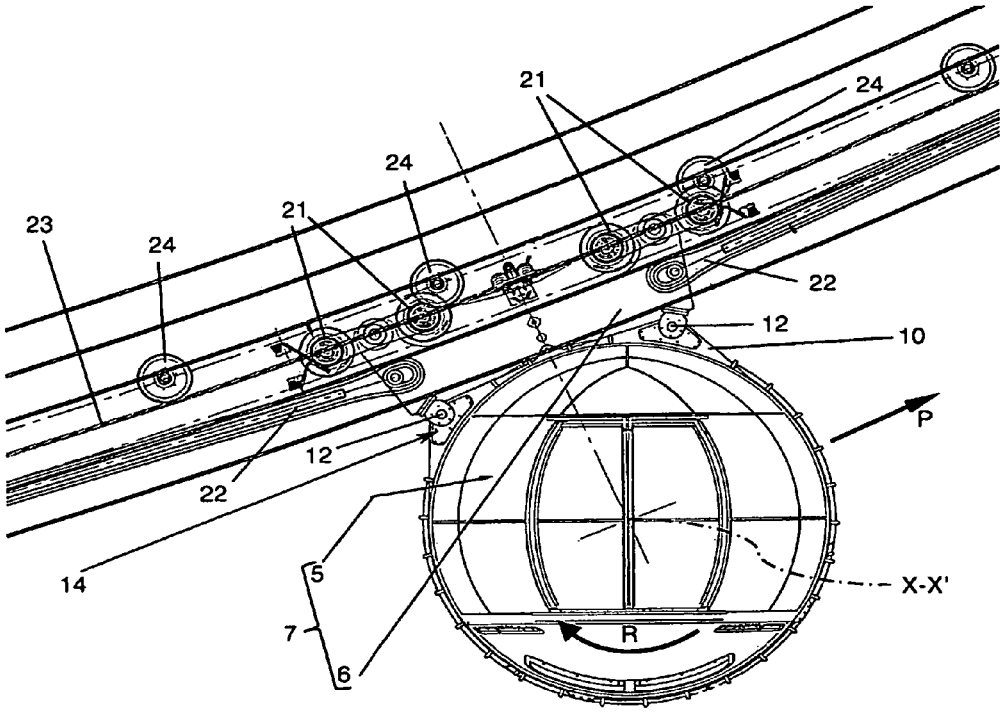
FIG. 2 is a magnification of a portion which is extracted from FIG. 1 and where one can see only one of the mobile cabins and only one of the support carriages for supporting the mobile cabins.

The path 4 guides a train of identical carriages, each of which supports a cabin 5 in compliance with the invention. In FIG. 2, such a carriage has the reference 6. A cabin 5 together with the carriage 6 equipped with this cabin forms one among a plurality of mobile cars 7.

Figure 3:
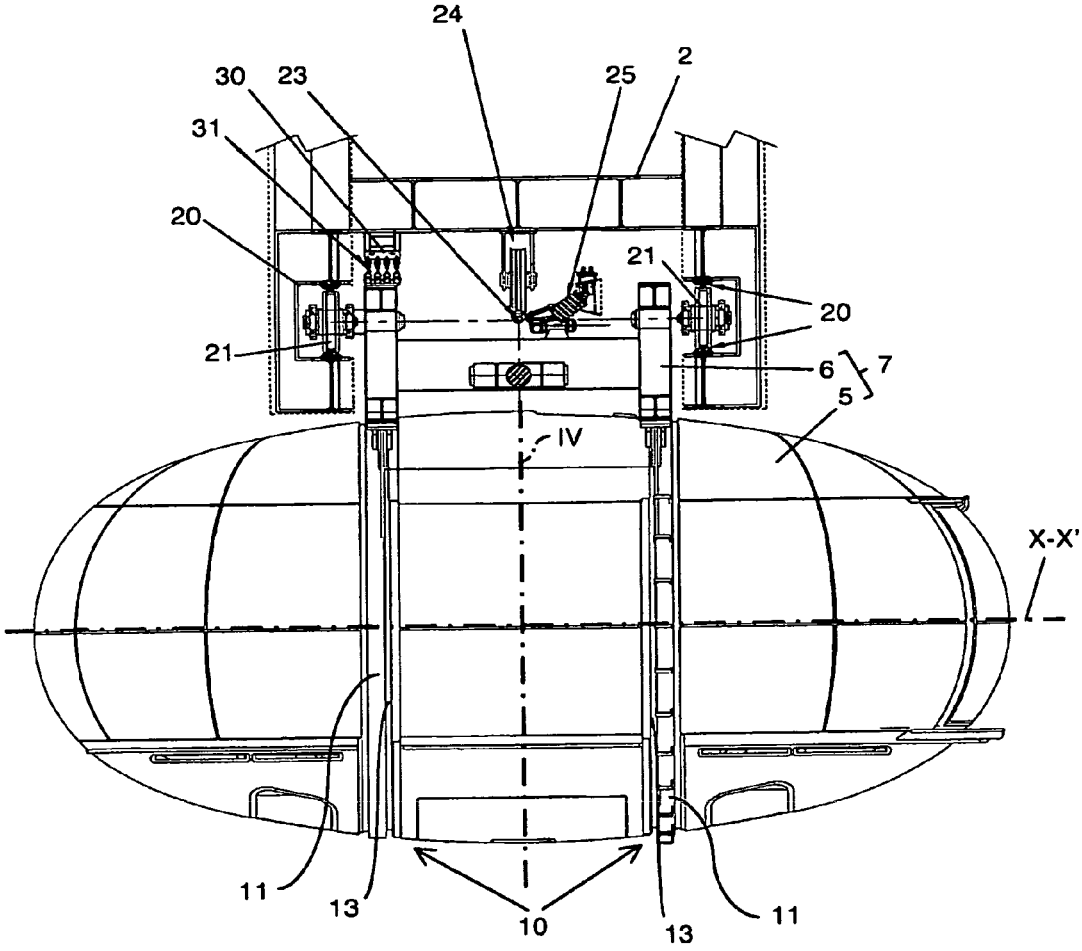
FIG. 3 is a front, partially sectional view showing the same cabin and the same support carriage as FIG. 2 and where a portion of a fixed central structure constitutive of the recreational facility is represented in a sectional view.

As it can be well seen in FIGS. 2 and 3, the cabin 5 is able to rotate and is held by a peripheral mounting device 10, through which it is mounted on the carriage 6 so as to be able to turn round on itself. The cabin 5 and the device 10 for rotationally mounting the same form a subset according to a first embodiment of the invention.

The substantially horizontal axis of rotation X-X' of the cabin 5 is substantially orthogonal to the direction of advancement of the carriage 6 along the path 4. In that way, due to a variation of the slope of this path 4 during the advancement P of the carriage 6, a variation of the slope of this carriage 6 relative to the horizontal can be compensated by a rotation R of the cabin 5 about its axis of rotation X-X', so that the floor of this cabin 5 remains substantially horizontal.

The mounting device 10 surrounds the cabin 5 and includes several pairs of crowns. The two crowns of each pair can turn relative one another. One of them is more precisely an attachment crown 11 rigidly fixed to the carriage 6 by means of several bolts 12. The other crown, having the reference 13, is the rotating crown, whose axis of rotation is the axis X-X'. Known per se and not represented in Figures, an annular bearing with axis of rotation X-X' belongs to the mounting device 10 and keeps assembled the attachment crown 11 and the rotating crown 13, which is rigidly attached to the cabin 5.

The attachment crown 11 comprises several fastening ears 14 angularly shifted from one another, each of which delimits a hole for the passage of the stem of a bolt 12.

As it can be seen in FIG. 3, the path 4 comprises two facing guide rails 20, each of them having a general shape of a 'U' in cross section and a bottom turned towards the other guide rail 20. Each carriage 6 is equipped with two of several rotating rollers 21, which support it while rolling freely in the guide rails 20.

The train of cars 7 is moved along the path 4 by means of a driving system which comprises a combination of coupling rods 22 and a traction cable 23, for example according to the teaching of above-mentioned European patent application EP-2 075 043. In FIG. 2 one can see two of the rods 22, each of them coupling two successive carriages 6 brought around the central structure 2.

The traction cable 23 is driven according to a closed loop. It runs over at least a part of its length between rails 20, by being guided by a set of return rollers 24 following one another along the path 4. As it can be seen in FIG. 3, each carriage 6 is equipped with a disengageable gripper 25 which can selectively connect said carriage to the traction cable 23 by engaging it or be placed in a disconnected position and be separated from this cable 23.

Indicated by the reference 26 in FIG. 1, a driving device for driving the traction cable 23 is located in one of the legs 3.

As it can be seen in FIG. 3, a live rail 30 is intended to power the cars 7 through collector brushes 31 with one of which each carriage 6 is provided.

Figure 4:
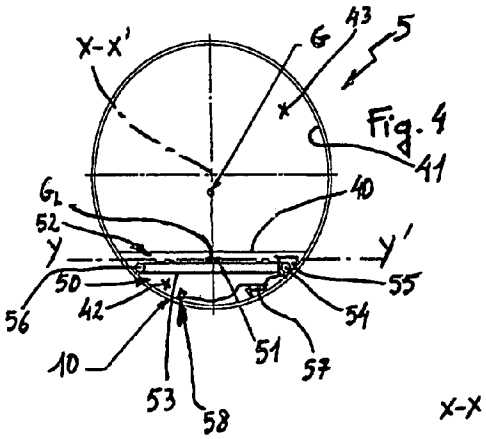
FIG. 4 is a schematic sectional view along the plane IV in FIG. 3.

The cabin 5 is empty in FIG. 4. It comprises a support floor 40 for supporting at least one passenger, for example from one to forty passengers, and/or other loads. The peripheral envelope 41 of the cabin 5 delimits an interior volume divided by this floor 40 into two spaces, namely a technical room 42 and a reception space 43 for one or more passenger(s), above this technical room 42. Like the floor 40, the technical room 42 and its equipment are arranged lower than the axis of rotation X-X', which extends through the reception space 43.

When the cabin 5 is transporting passengers, its floor 40 must remain substantially horizontal, a stabilization equipment 50 being therefore provided which comprises a mobile counterweight 51, in the technical room 42, and a driving device 52 for driving this counterweight in a direction Y-Y' substantially orthogonal to the axis of rotation X-X' about which the cabin 5 is able to turn around on itself.

The driving device 52 is comparable with a loop transporter and comprises an endless belt 53, which is tightened between two opposite return rollers and which supports the counterweight 51 so as to be able to move it very quickly. One of the return rollers is indicated by reference 54. It is coupled with the output shaft of an electric motor 55. The other return roller 56 is mounted so as to freely rotate.

An electronic check and control unit 57 controls the motor 55, from measures from a detection sensor 58 detecting the angular orientation of the cabin 5 about its axis of rotation X-X', relative to the horizontal. More precisely, the check and control unit 57 regulates the angular orientation of the cabin 5 around a predetermined angular orientation, which is that in FIG. 4 and in which the floor 40 is substantially horizontal.

Figure 5:
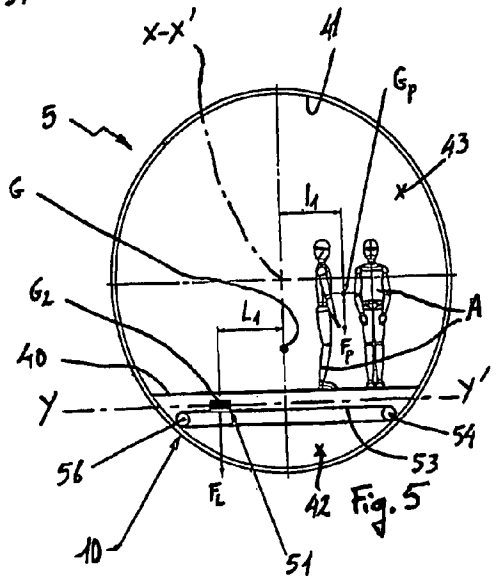
FIGS. 5 and 6 are schematic sectional views similar to that in FIG. 4 and illustrating the operation of a stabilizer of the cabin in FIGS. 2 and 3 when passengers in this cabin move the center of gravity of their total mass, for example when they all move in the same direction.
Figure 6:
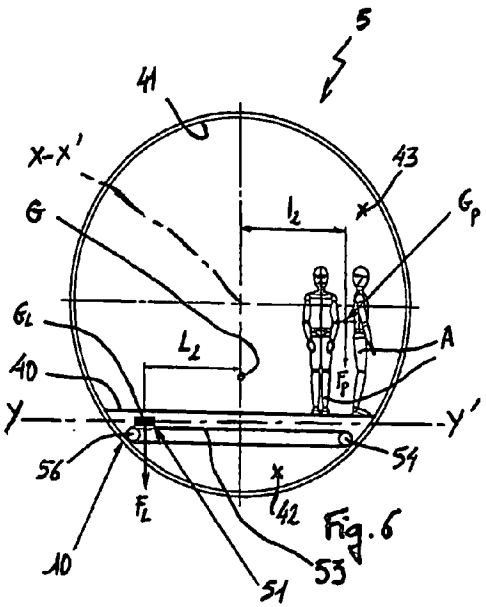

To this end, the unit 57 continuously checks the angular orientation of the cabin 5 around its axis of rotation X-X'. If it detects a difference between the effective orientation of the cabin 5 and the target, i.e. the predetermined angular orientation, the unit 57 carries out a correction by adjusting the position of the counterweight 51 in the direction Y-Y'. This counterweight 51 is thus moved towards balancing positions in which the momentum of its weight $F_L$ relative to the axis of rotation X-X' moves the cabin 5 back to the predetermined position and then compensates for an opposite momentum, that of the weight $F_P$ of the passengers, which is illustrated in FIGS. 5 and 6. In these Figures, the motor 55, the unit and the sensor 58 are not represented for reasons of simplification and clarity.

In FIG. 5, two passengers A of the cabin 5 have moved rightwards, so that their center of gravity $G_P$ has moved away by a distance $I_1$ from the vertical plane containing the axis of rotation X-X'. That results in the existence of a non-zero momentum of the weight $F_P$ of the two passengers A together, relative to this axis X-X'. This momentum would tend to make the cabin 5 turn round on itself if it were not compensated by a momentum of the same value but in an opposite direction, namely the momentum of the weight $F_L$ of the counterweight 51, which has been shifted leftwards to this end, by a distance $L_1$, from the vertical plane containing the axis of rotation X-X'.

In other words, the cabin 5 together with its passengers A form a whole with a moving center of gravity G, which the corrections made by the check and control unit 57 and using displacements of the counterweight 51 maintain substantially plumb with the axis of rotation X-X', with no or little rotation of the cabin 5 away from the predetermined orientation.

In FIG. 6, the same passengers A have moved more rightwards, which the counterweight 51 has compensated by an additional displacement leftwards. The center of gravity $G_P$ of the passengers A is now at a distance $I_2$ from the vertical plane containing the axis X-X'. Although this distance $I_2$ is longer than the distance $I_1$, the floor 40 is still substantially horizontal, since the center of gravity G has remained plumb with the axis of rotation X-X'thanks to a displacement of the counterweight 51 by a distance $L_2$ from the vertical plane containing the axis X-X', and not thanks to a rotation of the cabin 5.

Figure 7:
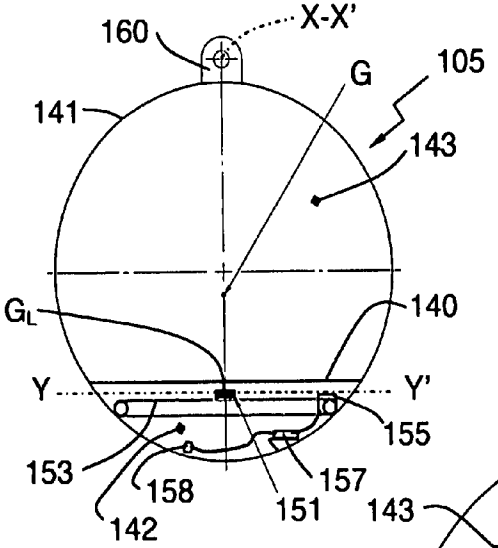
FIG. 7 is a schematic sectional view similar to that in FIG. 4 and representing a mobile cabin according to a second embodiment of the invention.

In FIG. 7, it is represented a cabin 105 and an upper mounting ear 160, which are constitutive of a mobile subset according to a second embodiment of the invention. In the following, it is described only the differences between this subset and that including the cabin 5 and the mounting device 10. Moreover, a reference used hereafter for indicating a part of the cabin 105 similar or equivalent to a referred part of the cabin 5 is obtained by adding one hundred to the reference of this part of the cabin 5. In this manner, one obtains in particular the references of the endless belt 153, the electric motor 155 and the sensor 158.

The cabin 105 is an oscillating cabin, i.e. intended to be suspended. To this end, it is provided with the upper ear 160, by means of which this cabin 105 is intended to be swingingly mounted under a mobile support and which comprises to this end one or more rotating mountings bearings such as rolling bearings. The mobile support to provide with the cabin 105 can be similar to a carriage 6, while being different therefrom so as to allow a cantilever installation of this cabin 105. It can also have another structure.

Once mounted, the cabin 105 can swing about an axis of rotation X-X', below which are located its envelope 141, and thus also the technical room 142 as well as the reception space 143 for the passengers A.

Figure 8:
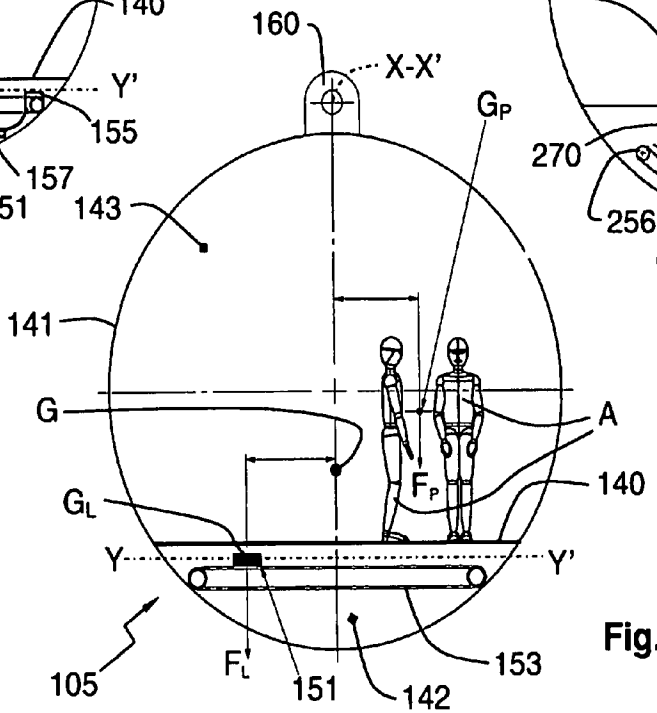
FIG. 8 is a schematic section view similar to those in FIGS. 4 to 7 and illustrating the operation of a stabilizer of the cabin in FIG. 7 when passengers of this cabin move the center of gravity of their total mass, for example when they all move in the same direction.

As in the first embodiment described previously, the electronic check and control unit 157 controls the position of the counterweight 151 in a guiding direction Y-Y' substantially orthogonal to the axis of rotation X-X' , so as to stabilize the cabin 105 around a predetermined position in which the floor 140 is substantially horizontal, which is illustrated in FIG. 8. In this Figure, the motor 155, the unit 157 and the sensor 158 are not represented for reasons of simplification and clarity.

The embodiment in FIGS. 7 and 8 is particularly advantageous in that it allows a new use. The oscillating nacelles have been used so far only in amusement parks where swinging is a source of amusement. Moreover, these oscillating nacelles are always of small sizes and can accommodate only a small number of people. Thanks to the invention, one can consider the use of oscillating cabins elsewhere than in amusement parks, in particular in facilities comfortably offering high points of view in cities or other places of interest. Still thanks to the invention, one can moreover consider the use of large-sized oscillating cabins. For example, the cabin 150 is designed to accommodate up to forty passengers even if only two passengers A are represented in FIG. 8, for reasons of clarity.

Figure 9:
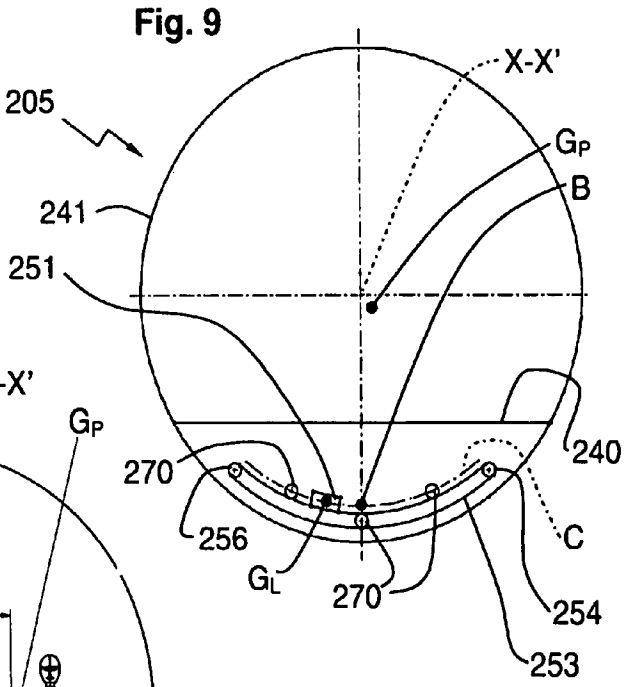
FIG. 9 is a schematic sectional view similar to that in FIG. 4 as well as that in FIG. 7 and representing a mobile cabin according to a third embodiment of the invention.

In FIG. 9, it is represented a mobile cabin 205 according to a third embodiment of the invention. In the following, it is described only the differences between this cabin 205 and the cabin 5. Moreover, a reference used hereafter for indicating a part of the cabin 205 similar or equivalent to a referred part of the cabin 5 is obtained by adding two hundreds to the reference indicating this part on the cabin 5. In particular, the reference of the peripheral envelope 241 is obtained in this manner. Moreover, the cabin 205 is equipped with a motor equivalent to the motor 55, an electronic check and control unit equivalent to the unit 57 and a sensor equivalent to the sensor 58, which are however not represented in FIG. 9, for reasons of simplification and clarity. Still in FIG. 9, passengers not represented are symbolized by their center of gravity $G_P$.

The cabin 205 is intended to be mounted on a mobile support, through a peripheral mounting device not represented and similar to the mounting device 10 in the first embodiment. Once thus mounted, this cabin 205 can rotate, relative to the mobile support. Its axis of rotation round on itself is indicated by the reference X-X'.

Between the driving roller 254 and the return roller 256, several rotating rollers 270 mounted so as to freely rotate guide the endless belt 253 so as to impose a specific path to it. This path has such a configuration that the mobile counterweight 251 has a travel C having substantially the shape of an arc of a circle. Viewed from above, this travel C is concave. More precisely, if one considers the cabin 205 in the predetermined angular orientation in which the floor 240 is substantially horizontal, the curve C comprises a low point B in the middle, substantially straight below the axis of rotation X-X', as well as two sections meeting at this low point B and continuously rising as one moves away from the low point B.

In the case of a failure such as a power failure or another problem regarding the control of the position of the counterweight 251, this counterweight 251 moves under its own weight along the travel curve C towards the lowest point B. Once at this low point B, the counterweight 251 is locked, which results in a passive safety in the event of a problem.

The invention is not limited to the embodiments described previously. In particular, if the trajectory of the cabins has the general shape of a vertical circle, the invention can be implemented in the previously-described case of a fixed central structure 2 as well as in the case of a conventional Ferris wheel, in which the central structure turns round on itself and has the shape of a wheel comprising spokes and a rim connected by these spokes to a central bearing of horizontal axis. In the case of such a conventional Ferris wheel, there is no carriage 6 and the crown 11 or ear 160 is mounted directly on the rim of the rotating wheel, which forms the mobile support instead of each carriage 6.

Moreover, the trajectory of the cabins 5, 105 and/or 205 can have a shape different from that of a vertical circle even if, in the embodiments exposed previously, the supports of these cabins perform a circular motion.

Moreover, instead of being mounted by means of one or more annular bearings in the device 10, the cabin 5 can be mounted on the carriage 6 via a set of wheels rolling on one or more travelling paths having the shape of a ring or a portion of a ring. This possibility is an advantage per se even if, because of the techniques and knowledge available today, the mounting of the cabins 5 by means of annular bearings is preferred.

The invention claimed is:

1. Mobile cabin for the reception and the transport of at least one passenger, to be mounted on a mobile support so as to rotate relative to a substantially horizontal axis of rotation, said cabin together with a possible load in this cabin forming a whole having a center of gravity, the mobile cabin comprising at least one counterweight movable between balancing positions away from a vertical plane containing said axis of rotation; and a motorized driving device for driving the counterweight between the balancing positions for balancing the cabin around a predetermined angular orientation of the cabin relative to the horizontal, by correcting the horizontal position of said center of gravity.

2. Mobile cabin according to claim 1, wherein the motorized driving device comprises at least one motor for moving the counterweight between said balancing positions;

at least one sensor for detecting an angular orientation of the cabin about an axis of rotation of the cabin, relative to the horizontal; and a unit for checking said angular orientation, from a measure from the sensor, and controlling the motor in order to stabilize said angular orientation of the cabin around said predetermined angular orientation.

3. Mobile cabin according to claim 1, wherein the counterweight is movable in at least one direction substantially orthogonal to said axis of rotation.

4. Mobile cabin according to claim 1, further comprising a floor, wherein the counterweight and at least part of the driving device for driving said counterweight are located under the floor.

5. Mobile cabin according to claim 1, wherein the counterweight is arranged in a lower position than the axis of rotation of the cabin.

6. Mobile subset for the reception and the transport of at least one passenger, comprising at least one cabin according to claim 1 for the reception and the transport of at least one passenger; and at least one mounting device for mounting said cabin on a mobile support so that the cabin can rotate relative to a substantially horizontal axis of rotation.

7. Mobile subset for the reception and the transport according to claim 6, wherein the mounting device is a device for mounting the cabin so that the cabin can turn round on itself.

8. Mobile subset for the reception and the transport according to claim 6, wherein the mounting device is a device for suspending the cabin from the mobile support.

9. Recreational facility, comprising a succession of at least some of the mobile subsets according to claim 6 for the reception and the transport of passengers;

at least one mobile support supporting at least one of the mobile subsets;

a fixed support structure for supporting the mobile support; and a driving system for driving the mobile support relative to the fixed structure.

* * * * *